United States Patent [19]

Sakaoka

[11] 3,948,597

[45] Apr. 6, 1976

[54] DUPLEX MULTICOLOR PRINTED CLOTH AND METHOD FOR THE PRODUCTION OF THE SAME

[75] Inventor: Hiroshi Sakaoka, Kyoto, Japan

[73] Assignee: Hayashi Chemical Industry Co., Ltd., Kyoto, Japan

[22] Filed: Sept. 23, 1974

[21] Appl. No.: 508,515

[52] U.S. Cl. ..... 8/14; 8/149; 8/179

[51] Int. Cl.[2] ..... D06P 1/58; D06P 3/00

[58] Field of Search ..... 8/14, 15, 16

[56] References Cited

UNITED STATES PATENTS

| | | | |
|---|---|---|---|
| 803,421 | 10/1905 | Kübler | 8/14 |
| 1,275,771 | 8/1918 | Scott | 8/14 |
| 1,814,783 | 7/1931 | Belokopytoff | 8/16 |
| 1,873,000 | 8/1932 | McCarthy | 8/14 |
| 2,050,260 | 8/1936 | Black | 8/14 |
| 2,068,770 | 1/1937 | Schwarzschild | 8/14 |
| 2,475,672 | 7/1949 | Mellor et al. | 8/15 |
| 3,374,731 | 3/1968 | Thorne | 101/129 |
| 3,468,694 | 9/1969 | Moritz et al. | 8/62 |

*Primary Examiner*—Ronald W. Griffin
*Attorney, Agent, or Firm*—Amster & Rothstein

[57] ABSTRACT

The opposite surfaces of a cloth are dyed with different dyes having different color tones, respectively. At least one of the opposite surfaces of the cloth is dyed by printing in a fine spot pattern and assumes a mixed multicolor fine spot dyed pattern in cooperation with the dyed color at the other surface which is penetrated or seen through the cloth.

6 Claims, No Drawings

DUPLEX MULTICOLOR PRINTED CLOTH AND METHOD FOR THE PRODUCTION OF THE SAME

BACKGROUND OF THE INVENTION

This invention relates to a duplex multicolor printed cloth and a method for the production of the same.

The industrial usefulness of double-surface multicolor dyeing is quite high in that there are many times when textile fabrics with the opposite surfaces of different color tones are desired for use as garments, interior decorations and other industrial materials.

Among those which have heretofore been supplied as textile fabrics with the opposite surfaces of different color tones there are included a double-surface multicolored fabric woven in double structure by using several kinds of threads dyed in different colors and a bonding fabric comprising a pair of textile fabrics of different colors bonded together to develop a color tone difference between the two sides. In these cases, there is no color tone difference between the two sides of a single thread.

With respect to the double-surface multicolor dyeing, various attempts have been made to prevent penetration of a dye applied on one surface into the opposite surface. However, it has been extremely difficult to fix the dye on one surface alone and allow it to develop its own color.

Another proposed double-surface multicolor dyeing method is to use a light sensitive material. In this method it is impossible to completely prevent the penetration of the dye on one surface into the other surface as well as in other conventional method, and accordingly, it only finds its usefulness for limited uses To enumerate the drawbacks of the double-surface multicolored textile fabrics currently supplied, (1) the double-surface multicolored fabric of double weave construction is limited to a thick fabric; (2) the double-surface multicolored fabric of a bonding structure is also limited to a thick fabric; (3) in each of the cases (1) and (2), it is necessary to use fibers dyed in separate processes; (4) with the technique which performs the dyeing of both sides separately, it is often impossible to completely prevent the penetration of the dye applied on one surface into the back or opposite surface; and (5) the methods in which light, heat or other physical or chemical conditions applied to one of the surfaces of a fabric there is a limitation in coloring matters which will respond to such treating conditions.

The present invention is intended to provide a method which eliminates the drawbacks of the known double-surface multicolor dyeing methods as described above and which provides a novel attractive multicolor effect.

SUMMARY OF THE INVENTION

According to the invention a cloth material is dyed at its opposite surfaces with different dyes having different color tones, respectively. At least one of the surfaces of the cloth is dyed by printing in a fine spot pattern and assumes a mixed multicolor fine spot dyed pattern in cooperation of the initially applied fine spot pattern thereto with the dyed color at the other surface which is penetrated or seen through said cloth.

In a preferred embodiment of the invention the opposite surfaces of the cloth are dyed by printing with different dyes having different color tones in the respective fine spot patterns so that the opposite surfaces of the cloth assume different mixed multicolor fine spot dyed patterns, respectively.

DETAILED DESCRIPTION OF THE INVENTION

Generally, in case of a colored design dyed on one surface, the coloring matter, according to the construction of the textile fabric, tends to penetrate into the back side with difficulty where the fiber bunch is dense and with ease where it is sparse, as is well known in the art. Further, even if there is no penetration of the coloring matter, the color tone on the opposite surface can be seen locally according to the density of fibers if it is seen through from the back side.

On the other hand, when a textile fabric is dyed on one surface thereof with measures taken to prevent the penetration of the coloring matter, it often occurs that a dirty spot pattern appears on the back surface in connection with the density differential of the textile fabric.

This is also the case with the duplex multicolor dyed cloth according to the present invention and a fabric subjected to multicolor spot dyeing will have a spot pattern appearing on the back surface, but it is possible to develop a duplex multicolor dyeing effect by utilizing the color tone of the coloring matter which is visible due to the penetration or transmission thereof while dyeing the opposite surface in a multicolor spot design of different color tone.

Thus, the present invention is intended to dye the opposite surfaces of a textile fabric to form thereon definitely or indefinitely shaped spot dyed designs of different color tones, wherein the spot pattern with a color tone which is visible on each surface due to the penetration or transmission of the coloring matter is utilized, thereby providing a textile fabric with both surfaces of different color tones. If the opposite surfaces of a fabric are merely subjected to plain level dyeing, the described difference in the degree of penetration into the back side and in the degree of transmission according to the density of fibers would result in the opposite surfaces being dyed dirty and uneven, having no decorative value and unfit for practical use. If, however, the opposite surfaces of a fabric are dyed in fine spot patterns by using dyes of different color tones, as in accordance with the present invention, the existence of the resulting spot patterns, even if the penetration or seeing-through effect of the dye from the back side gives a spot pattern, provides an interesting varicolor or multicolor spot effect attributable to the existence of various colors without detracting from the decorative effect as a whole.

The dyes to be applied to both surfaces of a fabric in carrying out the double-surface multicolor dyeing method according to the present invention may be monochromatic or polychromatic. The only requirement is that the opposite surfaces are dyed using dyes of different color tones with at least one surface dyed by printing in a fine spot pattern. As for the method of dyeing, the entire surface may be plain dyed or dyed in a print fashion in terms of a pattern.

Among the effective multicolor spot dyeing methods to develop the duplex multicolor dyeing effect according to the invention, there is included a single liquor multicolor dye method utilizing hydrogel particles containing dyes, as disclosed in Japanese Pat. No. 50,359 of 1972 published on Dec. 18, 1972. Another recommendation is to utilize dye particles granulated in a diameter of 10 to 1000 microns and coated with a water-soluble high molecular substance capable of temporarily preventing the dissolution of the dye into the dye medium. It is also recommendable to print a cloth with multicolored designs of irregular spots having diameter about 50 to 3000 microns by using a mixture of a plurality of kinds of granulated dyes having different colors. The fine spot dyeing effect can also be obtained when a fabric using a blended span yarn or a doubled twisted yarn of different fibers is dyed with a dye which will exhibit different dyeing properties with respect to those fibers.

The present invention is useful particularly when a multicolored spot design is to be formed on a plain fabric, but it is also applicable to a fabric printed with a particular pattern. In the latter case, dyeing can be partially carried out in a circle, triangle, square or other geometrical figure. In that case, a double-surface multicolor dyeing effect of mixed colors will be developed in areas where both the front and the back are dyed.

PREFERRED EMBODIMENT OF THE INVENTION

The following examples serve to illustrate the invention in more detail although the invention is not limited to the examples. Unless otherwise indicated, the amounts of the components are designated by parts by weight.

EXAMPLE 1

20 parts of CI Disperse Yellow 23 (CI No. 10338) were dispersed in 50 parts of water to prepare a dispersion including dye particles having diameter within the range of 0.5 to 5 microns. 15 parts of a water solution of 10% pure gelatin was added to the dispersion to form a mixture. The mixture was left as it was for 3 to 5 hours to form coagulated particles. The size of the obtained coagulated particles were regulated with use of an agitator into 10 to 150 microns. The dye particles thus prepared were mixed with 0.2 parts of 37% formalin, 48 parts of sodium chloride, 5 parts of carboxymethyl cellulose and 5 parts of etherified locust bean gum (50 to 80 cps in a 2% aqueous solution) to form 100 parts of a paste. Thus obtained paste including dye particles are hereinafter referred to as "MCP Yellow HP-Y."

CI Disperse Blue (CI No. 61505) and CI Disperse Red (CI No. 11210) were used instead of CI DIsperse Yellow (CI No. 10338) in a similar manner to the above to prepare another dye particles pastes. The obtained blue and red dye particle pastes are hereinafter referred to as "MCP Blue HP" and "MCP Red HP-R," respectively.

10 parts of MCP Yellow HP-Y and 10 parts of MCP Blue HP were mixed with a 10% aqueous solution of locust bean gum, making 100 parts in total. The thus prepared printing paste was printed on one surface of a polyester crepe de Chine fabric using a plain roll. The printed fabric was then dried. The opposite surface was similarly printed and then dried by using a printing paste made by mixing 10 parts of MCP Red HP-R and 10 parts of MCP Blue HP with an aqueous solution of 10% carboxymethyl cellulose, making 100 parts in total.

The fabric was then subjected to a steaming at 130°C for 20 minutes, followed by washing with water and soaping in a usual manner.

The fabric thus treated had on one surface thereof a multicolored spot design consisting of a mixture of a spot design in yellow, blue, their blend and green on one side and a spot design, penetrated or transmitted from the back, in red and blue, with red and blue forming the principal color tone on the opposite surface. In this way, a double-surface multicolored fabric having penetrated or transmitted spot designs was obtained.

EXAMPLE 2

| | |
|---|---|
| CI Acid Yellow 17 | (CI No. 18965) |
| CI Acid Orange 45 | (CI No. 22195) |
| CI Acid Blue 59 | (CI No. 50315) |
| CI Acid Red 114 | (CI No. 23635) |

10 parts of each of the above four dyes in a powder form were dispersed in 90 parts of water and the dispersion system was mixed with a 20% aqueous solution of 20% stearile trimethylammonium chloride. Then 100 parts of a 10% aqueous solution of aluminum sulfate and 100 parts of dextrin were mixed together into a mud form. The mud-like substance was added to 1000 parts of a 10% aqueous solution of carboxymethyl cellulose (viscosity: 20 CPS in a 20% solution, hereinafter referred to as "CMC") and slowly stirred to form dye particles in the CMC liquid. Thus, four kinds of granulated dye pastes of different colors, namely, yellow, orange, blue and red were prepared.

As for a printing ink, 200g of the yellow granulated dye paste and 20g of the red granulated dye paste were mixed with 500g of a 10% aqueous solution of a etherified guar gum (in a 2% aqueous solution, 30cps) and 50g of urea to prepare a single-surface printing dye.

As a dye for the opposite surface, an ink was prepared under the same conditions as the above using 200g of the orange granulated dye paste and 200g of the blue granulated dye paste.

By the use of the above-mentioned dyes, a wool muslin fabric was subjected to multicolor spot printing by roller printing process with one surface first and then the other. After drying, it was subjected to steaming at 100°C for 60 minutes, followed by washing. In this way, a double-surface multicolored fabric was obtained with spots of yellow and red predominating in the surface with sparse spots of blue and orange and with a reversed combination of color tones.

EXAMPLE 3

Cotton broadcloth was dyed using a color bath including 10% owf of CI Reactive Yellow 6 (CI No. 18972) and 80 g/l of Glauber's salt, in a liquor ratio of 1 : 40, 70°C for 20 minutes, with 20 g/l of sodium carbonate added. The dyeing was conducted at 80°C for 40 minutes, providing a bright yellow dyed fabric.

Next, 100g of CI Vat Red 2 (CI No. 73365) and 50g of refined gelatin were mixed with 850g of water and heated to 80°C in a water bath to dissolve the same, whereupon it was cooled to 40°C and, with 50g of glacial acetic acid, it was vigorously stirred and then cooled to about 10°C.

The resulting gel-like substance was crushed to a size of about 0.1–2mm and 10% thereof was mixed with a 3% aqueous solution of sodium alginate (300 cps grade article).

This was used as a printing ink to print one surface of the prepared yellow dyed fabric by a plain roll.

Thereafter, an aqueous solution of 5% hydrosulfite, 5% caustic soda and 20% wheat starch was used to blotch the printed surface by a blotching roll. The fabric was then subjected to ageing for 30 seconds, followed by neutralization and oxidation to cause the vat dye to develop its color.

The fabric thus treated had multicolored spot designs wherein one side was a dyed surface with a predominant orange tone in combination with peering spots of red transmitted from the back, on a yellow background, while the opposite surface had predominant red spots with a bright yellow appearing in the clearances between the spots.

EXAMPLE 4

1% of an aqueous dispersion of 25% Phthalocyanine Blue (CI No. 74660) was added to an emulsified mixture of 20% acrylic emulsion resin (made mainly of ethylacrylate and methyl ester, 45% conc. article), 20% water and 59% mineral turpentine to prepare a printing ink, with which the broadcloth obtained in Example 3 having one surface thereof plain level dyed and the other surface spot dyed was screen-printed on the plain level dyed side thereof to have a fine pattern of polka dots having an average diameter of 1 mm on the colored surface where orange was the predominant hue. The pigment was fixed by baking and the color tones on the front and back of the fabric were observed.

For comparison purposes, fabrics dyed orange and red, respectively, in the usual plain dyeing process were also subjected to fine pattern printing with blue.

The ground dyed fabric level dyed and printed had a pattern which constituted a practical design but which had a noticeable color tone unevenness in the transmitted spots, so that it was unfit for practical use.

In contrast therewith, the fabric dyed to have multicolored spot designs according to the present invention had the unevenness in transmitted spot designs cancelled by other spot designs, so that the designs were balanced as a whole. The double-surface multicolor dyed fabric obtained in this example was a fabric with the blue pigment print surface having a greenish pear-skin appearance and the back side having a red brown pear-skin appearance.

EXAMPLE 5

A plain fabric with warp yarn polyester filaments and weft yarn polyester 65/cotton 35 was prepared.

One side of the fabric was roller-printed all over the surface using a printing ink comprising:

| | |
|---|---|
| CI Disperse Violet 8 (CI No. 62030) | 2% |
| Water | 20% |
| Clay | 10% |
| Emulsion paste of sodium alginate | 68% |

The opposite surface was printed in a fine pattern of polka dots having a diameter of 1 mm by using a printing paste comprising:

| | |
|---|---|
| CI Reactive Red 17 (CI No. 18155) | 2% |
| Water | 20% |
| Clay | 10% |
| Sodium carbonate | 2% |
| Urea | 5% |
| Sodium alginate emulsion | 61% |

The fabric was then introduced into a heat zone at 180°C where it stayed for 60 seconds for fixation of the dye. It was soaped.

The fabric thus treated had a double-surface multicolor dyeing effect wherein the geometrical pattern effect of the blend spun and combined weave texture was in harmony with the spot colors transmitted from the back, giving the feeling that it was darker than the original colors of the dyes used, but the fabric had a pear-skin pattern with red and violet predominating therein.

EXAMPLE 6

| | |
|---|---|
| Disperse dye | 10% |
| Water | 30% |
| Aqueous solution of 50% dicyandiamide formalin precondensate | 20% |
| Mica powder (50–150 micron dia. particles) | 20% |
| Aqueous solution of 10% aluminum acetate | 20% |
| Total | 100% |

With the above-mentioned mixing proportions, four disperse dye pastes were prepared of CI Disperse Yellow 8 (CI No. 12690), CI Disperse Red 4 (CI No. 60755), CI Disperse Violet 4 (CI No. 61105) and CI Disperse Blue 7 (CI No. 62500), respectively. On the other hand, 70 parts of an aqueous solution of 10% locust bean type gum, and 10 parts of an aqueous solution of 5% sodium alginate were mixed together to prepare a paste stock, with which 20 parts of each of the above-mentioned color pastes were mixed, thereby providing color pastes effective to develop spot dyeing effects. Next, two kinds of multicolor spot printing pastes were prepared by using said color pastes: One comprised 20 parts of Yellow, 70 parts of Violet and 10 parts of urea and the other comprised 20 parts of Red, 70 parts of Blue and 10 parts of urea. A polyester crepe de Chine fabric was screen-printed on both surfaces thereof by using said different color pastes one for one side. The fabric was then subjected to high pressure steaming. In this way, a double-surface multicolored fabric was obtained.

What I claim is:

1. A method for the production of a duplex multicolor printed cloth comprising dyeing the opposite surfaces of a cloth with different dyes having different color tones, at least one of the opposite surfaces of said cloth being dyed by printing in a fine spot pattern with a dispersion including dye particles granulated in a diameter of 10 to 1000 microns and coated with water-soluble high molecular substance capable of temporarily preventing the dissolution of the dye into the dye medium, and the dyed color at the outer surface being locally penetrated or seen through said cloth to assume a mixed multicolor fine spot printed pattern on said one surface of said cloth.

2. A method for the production of a duplex multicolor printed cloth according to claim 1 in which said one of said opposite surfaces of said cloth is dyed by printing in a multicolored fine spot pattern by using a mixture of a plurality of kinds of granulated dyes having different colors.

3. A method for the production of a duplex multicolor printed cloth according to claim 1 in which said fine spot pattern is formed of irregular spots having a diameter of about 50 to 3000 microns.

4. A method for production of a duplex multicolor printed cloth comprising dyeing the opposite surfaces of a cloth by printing with different dyes having different color tones in the respective fine spot patterns, each of said dyes comprising dye particles granulated in a diameter of 10 to 1000 microns and coated with a water-soluble high molecular substance capable of temporarily preventing the dissolution of the dye into the dye medium, the dyed color at each of the opposite surfaces being locally penetrated or seen through said cloth to assume a mixed multicolor fine spot printed pattern on each of the other surfaces of said cloth.

5. A method for the production of a duplex multicolor printed cloth according to claim 4 in which said one of said opposite surfaces of said cloth is dyed by printing in a multicolored fine spot pattern by using a mixture of a plurality of kinds of granulated dyes having different colors.

6. A method for the production of a duplex multicolor printed cloth according to claim 4 in which said fine spot pattern is formed of irregular spots having a diameter of about 50 to 3000 microns.

* * * * *